US008709117B2

(12) United States Patent
Maruyama

(10) Patent No.: US 8,709,117 B2
(45) Date of Patent: Apr. 29, 2014

(54) OIL SEPARATOR

(75) Inventor: Toru Maruyama, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 99 days.

(21) Appl. No.: 13/426,791

(22) Filed: Mar. 22, 2012

(65) Prior Publication Data

US 2012/0240537 A1 Sep. 27, 2012

(30) Foreign Application Priority Data

Mar. 25, 2011 (JP) ..... 2011-068866

(51) Int. Cl.
*B01D 39/00* (2006.01)

(52) U.S. Cl.
USPC ..... 55/476; 55/428; 55/385.1; 55/418; 55/424

(58) Field of Classification Search
USPC ..... 55/476, 320, 385.1, 418–419, 428–430, 55/432, 424–426, 435, 478; 96/131, 133, 96/151; 210/282, 284, 288, 359
See application file for complete search history.

(56) References Cited

U.S. PATENT DOCUMENTS 5,240,593 A * 8/1993 Moredock ..... 210/87

FOREIGN PATENT DOCUMENTS

| | | | |
|---|---|---|---|
| JP | 50-062752 | U | 6/1975 |
| JP | 58-076068 | U | 5/1983 |
| JP | 59-020818 | U | 2/1984 |
| JP | 61-106324 | U | 7/1986 |
| JP | 05-203293 | | 8/1993 |
| JP | 2005-069654 | | 3/2005 |
| JP | 2005-098534 | | 4/2005 |
| JP | 2006-029684 | | 2/2006 |
| JP | 2008-039222 | | 2/2008 |

* cited by examiner

*Primary Examiner* — Jason M Greene
*Assistant Examiner* — Karla Hawkins
(74) *Attorney, Agent, or Firm* — IPUSA, PLLC

(57) ABSTRACT

A disclosed oil separator provided in a flow path of a refrigerant gas flowing from a compressor to a refrigerator including a filter configured to form an internal space by including a filter material filtering out oil from the refrigerant gas, an upper lid bonded to an upper portion of the filter material, and a lower lid bonded to a lower portion of the filter material; a body accommodating the filter; a gas inlet pipe introducing the refrigerant gas into the internal space; and a gas outlet pipe ejecting the refrigerant gas from which the oil is filtered out by the filter from an upper portion of the body, wherein a lower end of the gas inlet pipe is opened to the internal space at a position higher than the lower lid and lower than a substantial center between the upper lid and the lower lid.

5 Claims, 10 Drawing Sheets

OIL SEPARATOR

CROSS-REFERENCE TO RELATED APPLICATIONS

This patent application is based upon and claims the benefit of priority of Japanese Patent Application No. 2011-068866 filed on Mar. 25, 2011, the entire contents of which are incorporated herein by reference.

BACKGROUND OF THE INVENTION

1. Field of the Invention

The present invention generally relates to an oil separator provided between a compressor and a refrigerator to separate oil contained in a refrigerant gas.

2. Description of the Related Art

Examples of a regenerative type refrigerator can include a Gifford-McMahon cycle refrigerator (a GM refrigerator), a Joule-Thomson refrigerator plus a GM refrigerator, a closed cycle refrigerator, and a Stirling refrigerator. Among these, the GM refrigerator is frequently used. The GM refrigerator is connected to a compressor. By adiabatically expanding a high-pressure refrigerant gas supplied from the compressor inside the refrigerator so that the high pressure refrigerant gas has a low pressure, cold thermal energy is generated in the refrigerant gas. By accumulating the generated cold thermal energy in a regenerative material, an ultralow temperature is obtainable.

The compressor is provided to increase the pressure of the low-pressure refrigerant gas returned from the GM refrigerator, i.e., a return gas, by its compressor body, and supply the return gas again to the refrigerator. The pressure of the return gas returned from the GM refrigerator is raised again by the compressor body and then the refrigerant gas is cooled using a refrigerant gas heat exchanging unit.

After the cooling process is performed, the refrigerant gas supplied from the compressor is sent to the oil separator and the oil is separated. An example of the oil separator is disclosed in Japanese Laid-open Patent Publication No. 2008-39222. The refrigerant gas from which the oil is separated is sent to an adsorber and is supplied as a supply gas to the GM refrigerator.

The oil separator includes a shell and a filter element. The shell includes an upper flange, a lower flange and a cylindrical portion. The filter element includes a filter member for catching oil contained in the refrigerant gas, an upper lid bonded to an upper portion of the filter member, a lower lid bonded to a lower portion of the filter member and a gas inlet pipe for introducing the refrigerant gas inside the filter member.

SUMMARY OF THE INVENTION

An aspect of the present invention is an oil separator provided in a flow path of a refrigerant gas flowing from a compressor to a refrigerator, the oil separator including a filter configured to form an internal space by including a filter material filtering out oil from the refrigerant gas, an upper lid bonded to an upper portion of the filter material, and a lower lid bonded to a lower portion of the filter material; a body configured to accommodate the filter; a gas inlet pipe configured to introduce the refrigerant gas into the internal space; and a gas outlet pipe configured to eject the refrigerant gas from which the oil is filtered out by the filter from an upper portion of the body, wherein a lower end of the gas inlet pipe is opened to the internal space at a position higher than the lower lid and lower than a substantial center between the upper lid and the lower lid.

DETAILED DESCRIPTION OF THE PREFERRED EMBODIMENTS

Figure 1:
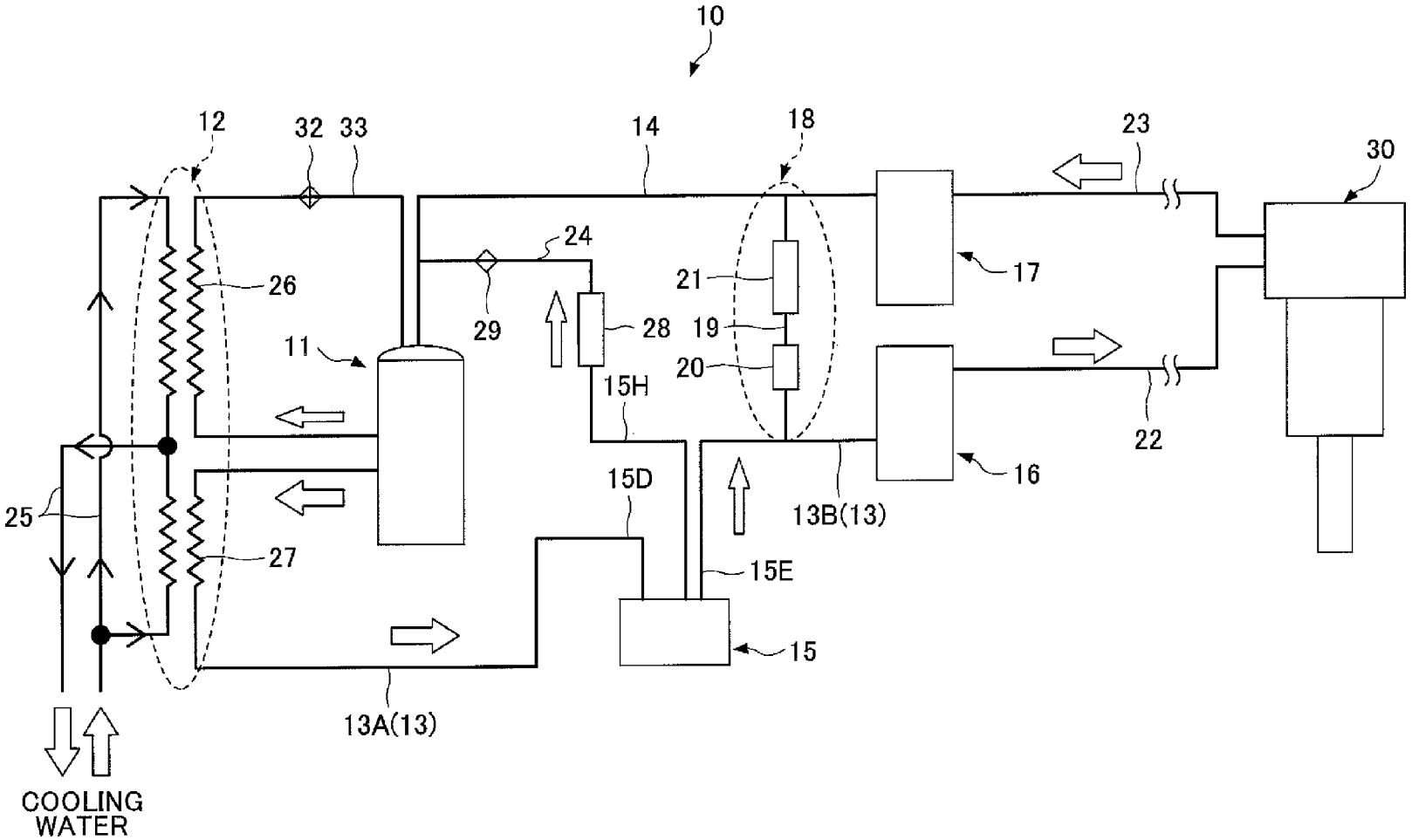
FIG. 1 illustrates an exemplary structure of a compressor for a regenerative type refrigerator of Embodiment 1.

The invention will now be described by reference to the preferred embodiments. This does not intend to limit the scope of the present invention, but to exemplify the invention.

The oil separator provided between the refrigerator and the compressor may have the following problems.

A part of the refrigerant gas containing the oil introduced from the gas inlet pipe passes through a filtering medium in an upper portion of the filter element. However, because a gas outlet pipe is opened on an upper portion of the oil separator, the path to the gas outlet pipe via the upper portion of the filter element is shorter than a path to the gas outlet pipe via a lower portion of the filter element. Therefore, it may not be possible to efficiently separate the oil from the refrigerant gas passing through the filtering medium on the upper portion of the filter element.

Further, when the refrigerant gas containing the oil passes through the filtering medium on the upper portion of the filter element, the oil mist contained in the refrigerant gas does not efficiently liquefy. Therefore, the oil contained in the refrigerant gas easily passes through the filtering medium as oil mist. As a result, the oil contained in the refrigerant gas may seep outward through the upper portion of the filter element.

As a result, the quantity of the oil rising from the oil separator via the gas outlet pipe, i.e., an oil outflowing quantity, increases because the oil is not efficiently separated from the refrigerant gas output from the gas outlet pipe.

Accordingly, embodiments of the present invention may provide a novel and useful oil separator, which can efficiently liquefy oil mist contained in a refrigerant gas supplied from a compressor for a refrigerator and efficiently separate the liquefied oil from the refrigerant gas, solving one or more of the problems discussed above.

The embodiments of the present invention may provide an oil separator provided in a flow path of a refrigerant gas flowing from a compressor to a refrigerator, the oil separator including a filter configured to form an internal space by including a filter material filtering out oil from the refrigerant gas, an upper lid bonded to an upper portion of the filter material, and a lower lid bonded to a lower portion of the filter material; a body configured to accommodate the filter; a gas inlet pipe configured to introduce the refrigerant gas into the internal space; and a gas outlet pipe configured to eject the refrigerant gas from which the oil is filtered out by the filter from an upper portion of the body, wherein a lower end of the gas inlet pipe is opened to the internal space at a position higher than the lower lid and lower than a substantial center between the upper lid and the lower lid.

Another aspect of the present invention may be to provide the oil separator wherein an area of a virtual cylindrical surface formed by extending an inner side periphery of the gas inlet pipe from the lower end to the lower lid is a cross-sectional area of the gas inlet pipe or greater.

Another aspect of the present invention may be to provide the oil separator wherein the lower lid is bonded to a lower portion of the filter material by an adhesive agent having a seal-up capability.

Another aspect of the present invention may be to provide the oil separator wherein the filter includes a liquefaction promoting member provided between the lower end of the gas inlet pipe and the lower lid to promote liquefaction of oil mist of the oil contained in the refrigerant gas, and a height of the lower end of the gas inlet pipe is opened to the internal space at a position higher than the liquefaction promoting member and at the position higher than the lower lid and lower than the substantial center between the upper lid and the lower lid.

Another aspect of the present invention may be to provide the oil separator wherein the liquefaction promoting member is made of a fibrous material.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

A description is given below, with reference to the FIG. 1 through FIG. 11 of embodiments of the present invention.

Embodiment 1

Referring to FIG. 1, a compressor for a regenerative type refrigerator having an oil separator of Embodiment 1 is described. A Gifford-McMahon cycle refrigerator (hereinafter, referred to as a "GM refrigerator") is exemplified as a regenerative type refrigerator.

FIG. 1 illustrates a structure of a compressor 10 for a regenerative type refrigerator of Embodiment 1.

The compressor 10 includes a compressor body 11, a heat exchanger 12, high-pressure side piping 13, low-pressure side piping 14, an oil separator 15, an adsorber 16, a storage tank 17 and a bypass mechanism 18. The compressor 10 is connected to a GM refrigerator 30 by supply piping 22 and return piping 23. The compressor 10 raises the pressure of a low-pressure refrigerant gas (a return gas) returned from the GM refrigerator 30 using the compressor body 11 and supplies the gas again to the GM refrigerator 30 via the supply piping 22.

The return gas returned from the GM refrigerator 30 flows into the storage tank 17 via the return piping 23. The storage tank 17 is provided to remove pulsations existing in the return gas. Because the storage tank 17 has a relatively large capacity, it is possible to remove the pulsations by introducing the return gas into the storage tank 17.

The return gas whose pulsations are removed by the storage tank 17 is led to the low-pressure side piping 14. The low-pressure side piping 14 is connected to the compressor body 11. Therefore, the return gas whose pulsations are removed is supplied to the compressor body 11.

The compressor body 11 is, for example, a scroll or rotary pump provided to raise the pressure of the return gas by compressing the return gas to change it to a high-pressure refrigerant gas (the supply gas). The compressor body 11 sends the high-pressure refrigerant gas (the supply gas) to a high-pressure side piping 13A (13). When the pressure of the supply gas is increased by the compressor body 11, oil inside the compressor body 11 is slightly mixed with the supply gas and the supply gas mixed with the oil is sent to the high-pressure side piping 13A (13).

The high-pressure side piping 13 corresponds to a refrigerant gas flow path through which the refrigerant gas flows from the compressor 10 to the GM refrigerator 30.

The compressor body 11 is cooled by the oil. Therefore, an oil cooling piping 33 for circulating the oil is connected to an oil heat exchanging part 26 forming the heat exchanger 12. An orifice 32 is provided inside the oil cooling piping 33 for controlling an oil flow rate of the oil flowing inside the oil cooling piping 33.

The heat exchanger 12 is formed to circulate cooling water inside cooling water piping 25. The heat exchanger 12 includes the oil heat exchanging part 26 for cooling the oil passing through the oil cooling piping 33 and a refrigerant gas heat exchanging unit 27 for cooling the supply gas. The oil passing inside the oil cooling piping 33 transfers heat to the oil heat exchanging part 26, and the supply gas to flow inside the high-pressure side piping 13 (13A) transfers heat to the refrigerant gas heat exchanging unit 27 so as to be cooled.

The supply gas whose pressure is raised by the compressor body 11 and cooled by the refrigerant gas heat exchanging unit 27 is supplied to the oil separator 15 via the high-pressure side piping 13A (13). The oil separator 15 separates not only the oil contained in the supply gas but also impurities and dust in the oil. A detailed structure of the oil separator 15 is described next.

The supply gas from which the oil is removed is sent to the adsorber 16 via the high-pressure side piping 13B (13). The adsorber 16 is provided to especially remove the vaporized oil components contained in the supply gas. When the vaporized oil component are removed by the adsorber 16, the supply gas is led into the supply piping 22 so as to be supplied to the GM refrigerator 30.

The bypass mechanism 18 includes bypass piping 19, a high pressure side pressure detecting device 20 and a bypass valve 21. The bypass piping 19 connects a high pressure side for the supply gas flow and a low pressure side for the return gas flow. The high pressure side pressure detecting device 20 is provided to detect the pressure of the supply gas inside the high-pressure side piping 13B. The bypass valve 21 is an electric-operated valve for opening and closing the bypass piping 19. The bypass valve is ordinarily closed and controlled to be driven by the high pressure side pressure detecting device 20.

Specifically, when the high pressure side pressure detecting device 20 detects that the pressure of the supply gas sent from the oil separator 15 and reaching the adsorber 16, i.e., the pressure inside the high-pressure side piping 13B, becomes a predetermined pressure, the bypass valve 21 is driven by the high pressure side pressure detecting device 20 so that the bypass valve 21 is opened.

A high pressure side of an oil returning piping 24 is connected to the oil separator 15, and a low pressure side of the oil returning piping 24 is connected to the low-pressure side piping 14. In the middle of the oil returning piping 24 are a filter 28 for removing dust contained in the oil separated by the oil separator 15 and an orifice 29 for controlling an oil returning quantity.

Next, referring to FIG. 1 to FIG. 4, an oil separator 15 of Embodiment 1 is described. The oil separator 15 of Embodiment 1 is a vertical type.

Figure 2:
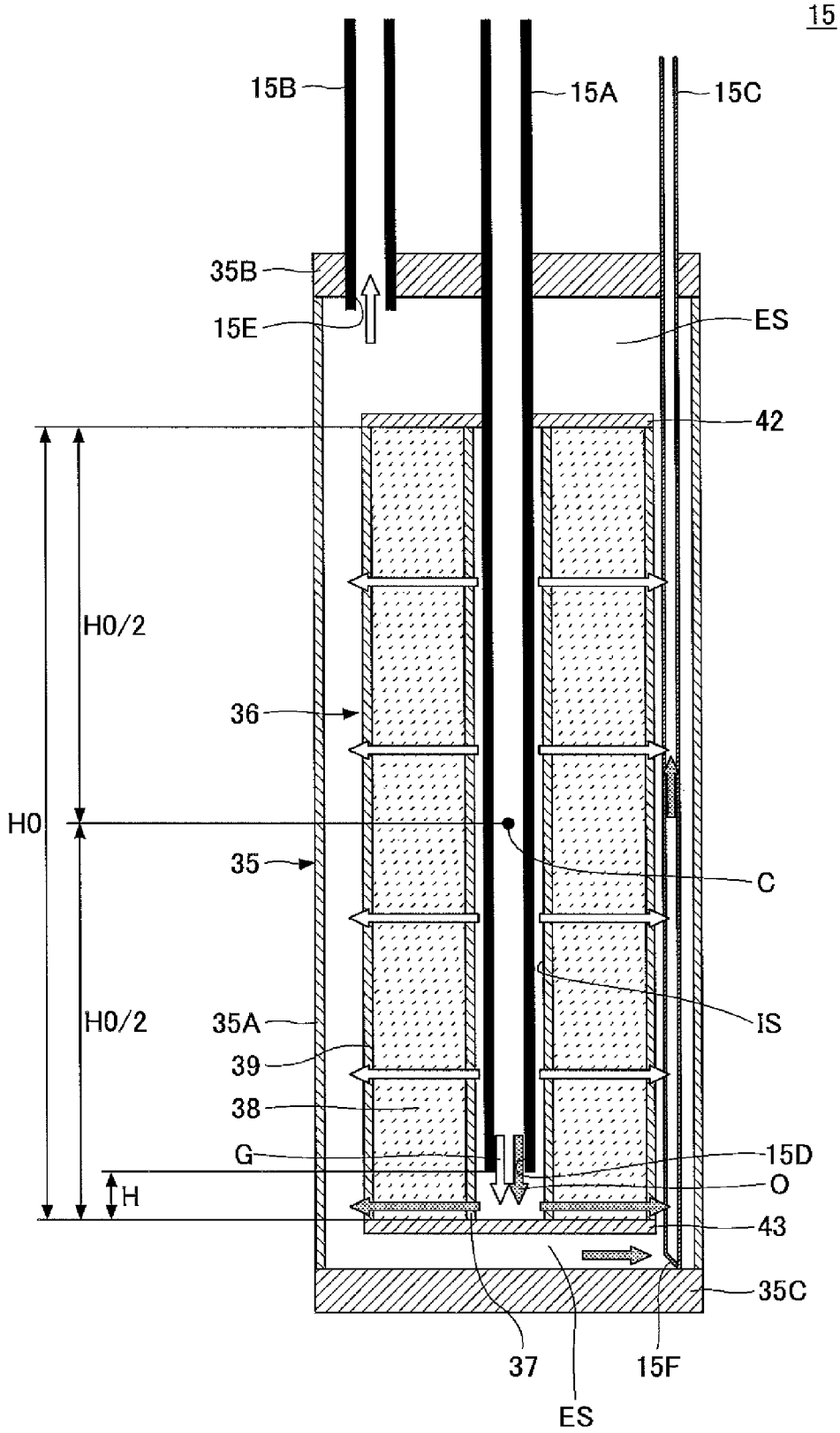
FIG. 2 is a cross-sectional view of the oil separator of Embodiment 1.

FIG. 2 is a cross-sectional view of an oil separator of Embodiment 1.

Referring to FIG. 2, a flow of the refrigerant gas is indicated by an arrow G, and a flow of the oil is indicated by an arrow O.

The oil separator 15 includes a shell 35 and a filter element 36.

For example, the shell 35 may correspond to a body in the claims, and the filter element 36 may correspond to a filter in the claims.

The shell 35 includes a cylindrical portion 35A, an upper flange 35B and a lower flange 35C.

The cylindrical portion 35A is a hollow cylinder. As axis of the cylindrical portion 35A extends upward and downward. The axis of the cylindrical portion 35A is arranged substantially in the vertical directions. The lower flange 35C is fixed to the lower end portion of the cylindrical portion 35A by welding so as to be airtight. The upper flange 35B is welded to an upper end portion of the cylindrical portion 35A so as to be airtight.

A high-pressure gas inlet pipe 15A, a high-pressure gas outlet pipe 15B, and an oil return tube 15C are provided with the upper flange 35B.

The high-pressure gas inlet pipe 15A corresponds to a gas inlet pipe. The high-pressure gas outlet pipe 15B corresponds to an outlet pipe in the claims.

The high-pressure gas inlet pipe 15A penetrates through the upper flange 35B. The high-pressure gas inlet pipe 15A penetrating through the upper flange 35B extends from the upper flange 35B to an upper lid 42 of the filter element 36 (described below) inside the shell 35 and further penetrates the upper lid 42. The high-pressure gas inlet pipe 15A is connected to the high-pressure side piping 13A (13) illustrated in FIG. 1 above the upper flange 35B. The high-pressure gas inlet pipe 15A introduces a refrigerant gas being a high pressure gas inside the oil separator 15.

The high-pressure gas outlet pipe 15B penetrates through the upper flange 35B. The lower end of the high-pressure gas outlet pipe 15B penetrating through the upper flange 35B is opened as a high-pressure gas outlet port 15E inside the shell 35, below the upper flange 35B and in the vicinity of the upper flange 35B. The high-pressure gas outlet pipe 15B is connected to a high-pressure side piping 13B (13) illustrated in FIG. 1 above the upper flange 35B. The high-pressure gas outlet pipe 15B ejects the refrigerant gas being the high pressure gas from the oil separator 15.

The oil return tube 15C penetrates through the upper flange 35B. The oil return tube 15C penetrating through the upper flange 35B extends in upward and downward directions inside the shell 35 to reach a position adjacent to the lower flange 35C. The lower end of the oil return tube 15C is opened as an oil ejection port 15F for ejecting the oil separated from the refrigerant gas. The oil return tube 15C is connected to the oil returning piping 24 illustrated in FIG. 1 above the upper flange 35B. The oil return tube 15C returns the oil from the inside of the oil separator 15.

The filter element 36 includes an inner cylindrical member 37, a filter member 38, an outer cylindrical member 39, an upper lid 42, a lower lid 43 and so on.

The inner cylindrical member 37 is obtained by bending a punching plate made of stainless steel or carbon steel to have a cylindrical shape. The filter member 38 is formed by the inner cylindrical member 37 having a cylindrical shape as a core, and a filtering medium wound around the inner cylindrical member in a cylindrical shape. The filtering medium is, for example, glass wool. The outer cylindrical member 39 may be formed by bending a punching plate made of stainless steel or carbon steel to have a cylindrical shape and provided to surround the filter member 38. The filter member 38 has a ring-like shape in a vertical cross-sectional view. An inner peripheral surface is reinforced by the inner cylindrical member 37 and an outer peripheral surface is reinforced by the outer cylindrical member 39.

The filter member 38 corresponds to a filter material in the claims.

Within the embodiments, the punching metal is used for the inner cylindrical member 37 and the outer cylindrical member 39, as an example. However, any material such as wire mesh, a plate having slits, and/or bar lattice may be used instead of the punching metal plate. The important aspect is that the filter member 38 is retained without preventing the gas flow and the oil can be separated.

The upper lid 42 and the lower lid 43 are provided to sandwich the inner cylindrical member 37, the filter member 28 and the outer cylindrical member 39 in upward and downward directions. The upper lid 42 and the lower lid 43 are bonded to an upper portion and a lower portion, respectively, of the filter member 38 by an adhesive agent.

The inner cylindrical member 37, the upper lid 42 and the lower lid 42 surround to form an internal space IS inside the inner cylindrical member 37. An external space ES is formed by the inside of the shell 35 and the outside of the filter element 36.

The high-pressure gas inlet pipe 15A penetrating through the upper flange 35B further penetrates through the upper lid 42. The high-pressure gas inlet pipe 15A penetrating through the upper lid 42 extends through the internal space IS in the upward and downward directions from the upper lid 42 to the lower lid 43, and the lower end is opened as a high-pressure gas inlet port 15D. The high-pressure gas inlet pipe 13A is provided to introduce the refrigerant gas into the internal space IS.

The refrigerant gas passing through the high-pressure gas inlet pipe 15A and being introduced into the internal space IS from the high-pressure gas inlet port 15D radially flows toward the outer periphery in a horizontal cross-sectional view through the filter member 37 in the order of the inner cylindrical member 37, the filter member 38 and the outer cylindrical member 39. When the refrigerant gas passes through the filter element 36, the oil contained in the refrigerant gas is filtered out so as to be separated from the refrigerant gas. The refrigerant gas from which the oil is separated is introduced into the external space ES. The refrigerant gas introduced into the external space ES is ejected via the high-pressure gas outlet port 15E to the high-pressure gas outlet pipe 15B.

Figure 3:
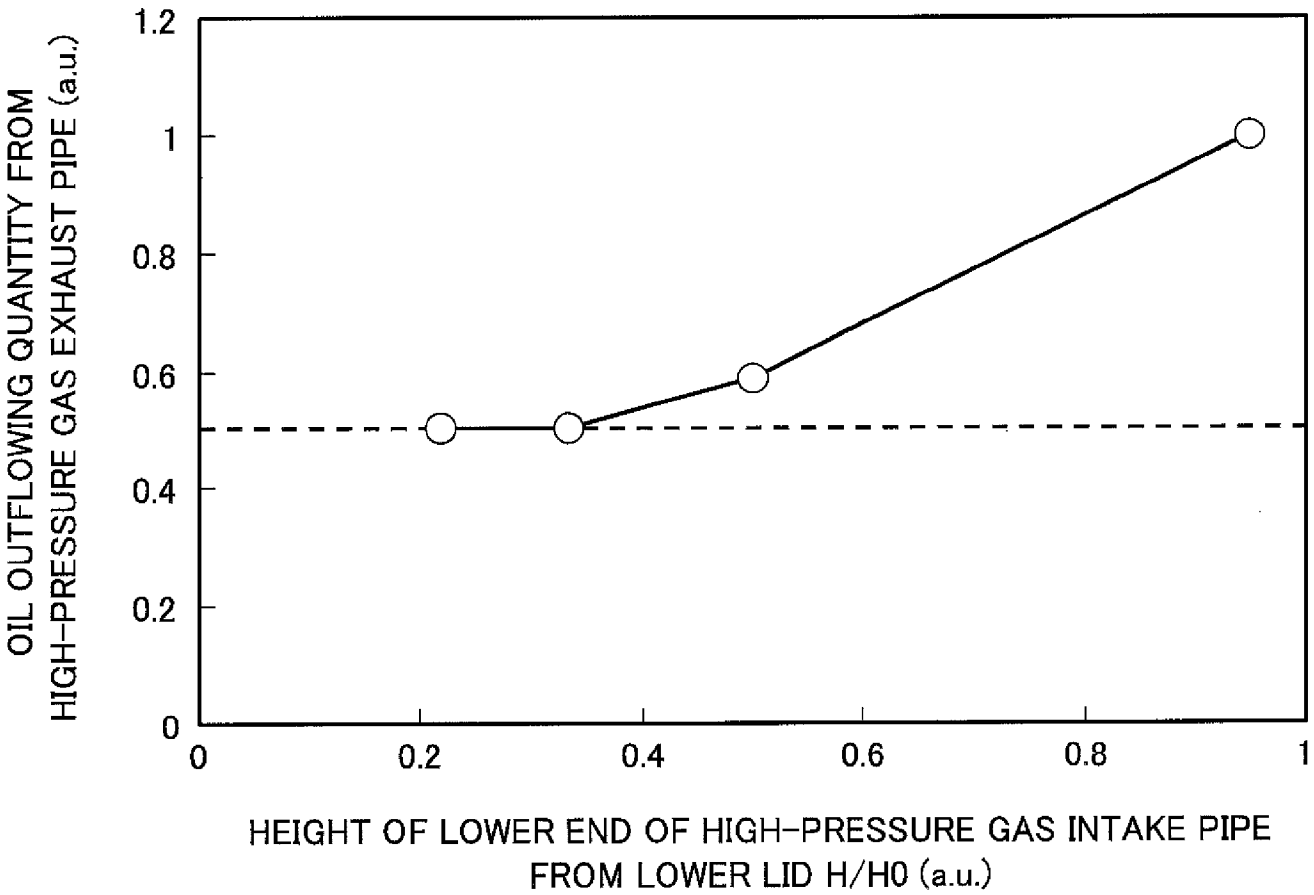
FIG. 3 is a graph indicating a measurement result of an oil outflowing quantity from a high-pressure gas outlet pipe when a height of the lower end of a high-pressure gas inlet pipe from a lower lid is varied.

FIG. 3 is a graph indicating a measurement result of an oil outflowing quantity from the high-pressure gas outlet pipe 15B when the height of the lower end of a high-pressure gas inlet pipe 15A from the lower lid 43 is varied.

As illustrated in FIG. 2, the height of the upper lid 42 from the lower lid 43 is H0. The height of the lower end of the high-pressure gas inlet pipe 15A from the lower lid 43, namely the height of the high-pressure gas inlet port 15D from the lower lid 43 is designated by H. FIG. 3 illustrates a change of the oil outflowing quantity from the high-pressure gas outlet pipe 15B caused when the height H is changed. For example, the change is measured by an oil trap provided in the high-pressure side piping 133 (13).

Referring to a graph illustrated in FIG. 3, the height of the lower end of the high-pressure gas inlet pipe from the lower lid 43 is normalized as "a height H/a height H0" and plotted on the axis of abscissa. The oil outflowing quantity from the high-pressure gas outlet pipe 15B corresponding to the height H is normalized by the oil outflowing quantity corresponding to the height H0 and plotted on the axis of ordinate on the graph of FIG. 3.

As illustrated in FIG. 3, when the normalized height H/H0 is reduced from 1 to 0, the oil outflowing quantity is also reduced. In a range where the normalized height H/H0 is smaller than about 0.5, the oil outflowing quantity converges on a substantially constant value. Accordingly, when the following relationship is satisfied, an effect of reducing the oil outflowing quantity is obtainable:

$$0<H<H0/2 \qquad \text{Formula 1}$$

When the lower end of the high-pressure gas inlet pipe 15A is positioned higher than the lower lid 43 and lower than a center C between the upper lid 42 and the lower lid 43 and opened inside the internal space IS, the oil can be efficiently separated from the refrigerant gas.

This function and effect of the efficient separation of the oil from the refrigerant gas caused when the lower end of the high-pressure gas inlet pipe 15A is positioned higher than the lower lid 43 and lower than a center C between the upper lid 42 and the lower lid 43 and opened inside the internal space IS are as follows.

For example, when the height of the high-pressure gas inlet port 15*d* is relatively high, the oil mist contained in the refrigerant gas introduced from the high-pressure gas inlet port 15D is sprayed on the lower lid 43 to thereby efficiently liquefy the oil mist.

Because the moving distance of the refrigerant gas from the high-pressure gas inlet port 15D to the high-pressure gas outlet port 15E through the oil separator is long, the liquefied oil can be easily separated while moving to enable efficient separation of the liquefied oil from the refrigerant gas.

Further, when formula 1 is satisfied, the quantity of the oil mist passing through the filter member 38 positioned higher than the center C between the upper lid 42 and the lower lid 43 becomes small. Therefore, even if the filter member 38 is not provided at the position higher than the center C, the oil flowing quantity can be reduced. Said differently, since the length of a portion of the filter member that is higher than the center C can be shortened, the total height of the filter member can be shortened so that the height of the oil separator can be shortened.

Figure 4:
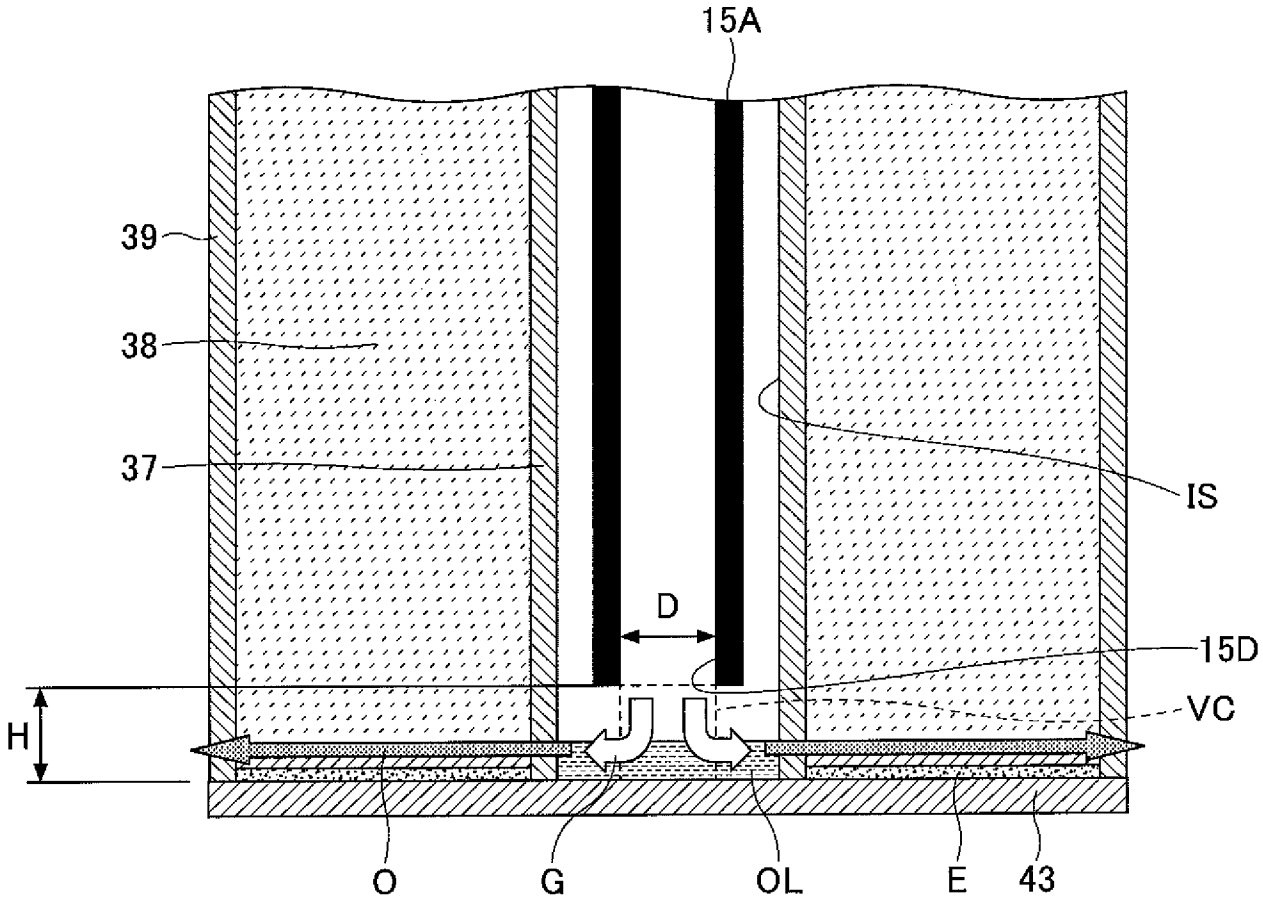
FIG. 4 is an enlarged cross-sectional view of the lower end of the high-pressure gas inlet pipe of the oil separator of Embodiment 1.
Figure 5:
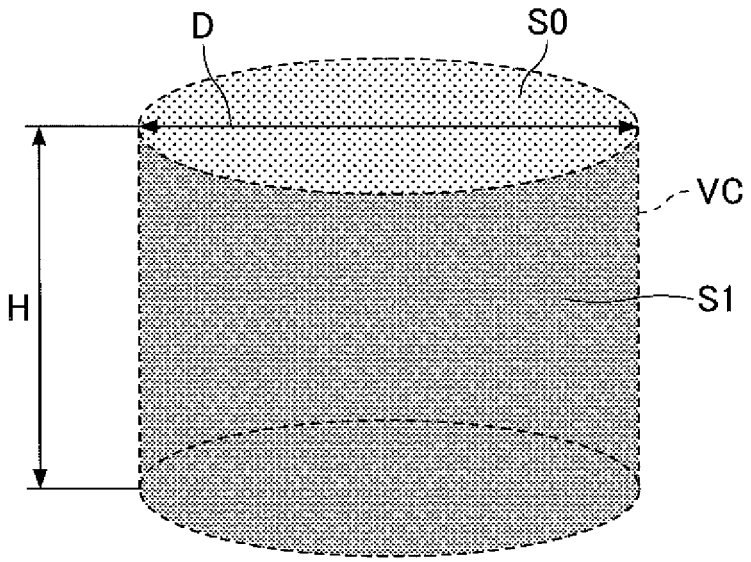
FIG. 5 schematically illustrates a virtual cylindrical surface extending from the lower end of the high-pressure gas inlet pipe to the lower lid through a side peripheral surface of the high-pressure gas inlet pipe.

FIG. 4 is an enlarged cross-sectional view of the lower end of the high-pressure gas inlet pipe 15A of the oil separator 15 and its vicinity of Embodiment 1. FIG. 5 schematically illustrates a virtual cylindrical surface VC extending from the lower end of the high-pressure gas inlet pipe 15A to the lower lid 43 through a side peripheral surface of the high-pressure gas inlet pipe 15A.

Referring to FIGS. 4-5, the virtual cylindrical surface VC may be formed by extending an inner side periphery of the high-pressure gas inlet pipe 15A from the lower end, namely the high-pressure gas inlet port 15D, to the lower lid 43. The diameter of the high-pressure gas inlet pipe 15A is designated by D and the cross-sectional area thereof designated by S0. At this time, the height of the virtual cylindrical surface VC is designated by H. When an area S1 ($S1=\pi DH$) of the virtual cylindrical surface VC is smaller than the cross-sectional area S0 ($S0=\pi(D/2)^2$) of the high-pressure gas inlet pipe 15A, a flow passage cross-sectional area for the flow G of the refrigerant gas below the lower end of the high-pressure gas inlet pipe 15A becomes smaller than a flow passage cross-sectional area inside the high-pressure gas inlet pipe 15A. Therefore, a pressure loss may occur in the gas at a time of changing the direction at the lower end to thereby decrease the pressure of the refrigerant gas being the high pressure gas introduced from the oil separator 15 and degrade refrigeration capacity of the refrigerator 30.

Therefore, it is preferable to make the area S1 of the virtual cylindrical surface VC be the cross-sectional area S0 of the high-pressure gas inlet pipe 15A or greater. In this case, the flow passage cross-sectional area of the flow G of the refrigerant gas which changes its direction at the lower end of the high-pressure gas inlet pipe 15A is the flow passage cross-sectional area inside the high-pressure gas inlet pipe 15A or greater. Therefore, a pressure loss does not occur in the gas at the time of changing the direction at the lower end to thereby prevent from decreasing the pressure of the refrigerant gas being the high pressure gas introduced from the oil separator 15 and degrading the refrigeration capacity of the refrigerator 30.

Referring to FIG. 4, it is preferable to bond the lower lid 43 to a lower portion of the filter member 38 by an adhesive agent E having a seal-up capability such as an epoxy adhesive and a silicon adhesive. With this bonding, it is possible to prevent a gap from occurring between the filter member 38 and the lower lid 43. Therefore, it is possible to prevent the refrigerant gas containing the oil, which is introduced from the high-pressure gas inlet port 15D into the internal space IS, from flowing through the gap into the external space ES. Further, it is possible to prevent the liquefied oil from flowing outward into the external space ES via the gap.

Embodiment 2

Figure 6:
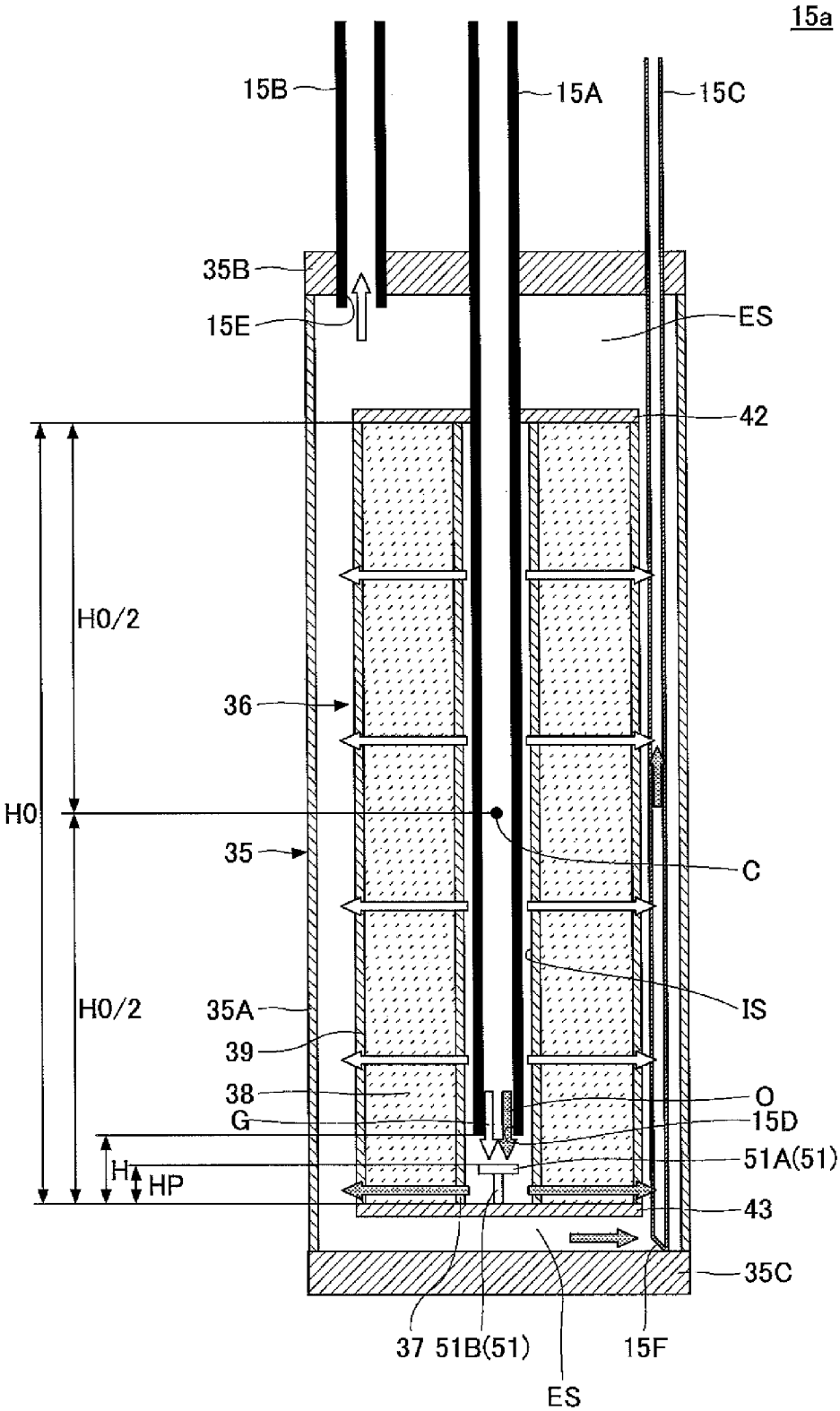
FIG. 6 is a cross-sectional view of an oil separator of Embodiment 2.

Referring to FIG. 6, an oil separator of Embodiment 2 is described. A liquefaction promoting member 51 is provided between the lower end of the high-pressure gas inlet pipe 15A and the lower lid 43 in the oil separator 15*a* of Embodiment 2.

FIG. 6 is a cross-sectional view of the oil separator 15*a* of Embodiment 2.

A structure the same as the oil separator 15 is provided in the oil separator 15*a* except for the liquefaction promoting member 51 and the high-pressure gas inlet pipe 15A in the oil separator 15*a*. Therefore, explanation of the portions other than the liquefaction promoting member 51 and the high-pressure gas inlet pipe 15A in the oil separator 15*a* is omitted.

The liquefaction promoting member 51 is provided between the lower end of the high-pressure gas inlet pipe 15A and the lower lid 43. When oil mist contained in the refrigerant gas introduced into the internal space IS is sprayed from the high-pressure gas inlet pipe 15A on the liquefaction promoting member 15A, liquefaction of the oil mist is promoted. The liquefaction promoting member 51 of Embodiment 2 includes an upper plate portion 51A having a disk-like shape in a plan view and a shaft portion 51B whose upper end is connected to a center of the upper plate portion 51A and whose lower end is connected to the lower lid 43 and which has a T-like shape in a side view. Liquefaction of the oil mist is promoted when the refrigerant gas containing the mist oil is introduced from the high-pressure gas inlet pipe 15A into the internal space IS and sprayed on the liquefaction promoting member 51.

Within Embodiment 2, the lower end of the high-pressure gas inlet pipe 15A is positioned higher than the upper end of the liquefaction promoting member 51 and opened toward the inside of the internal space IS at a position lower than the center C between the between the upper lid 42 and the lower lid 43, so that the oil can be efficiently separated from the refrigerant gas. Because the oil mist contained in the refrigerant gas introduced from the high-pressure gas inlet port 15D is sprayed on the lower lid 43, the oil mist can be efficiently liquefied. Because the moving distance of the refrigerant gas from the high-pressure gas inlet port 15D to the high-pressure gas outlet port 15E through the oil separator 15*a* is long, the liquefied oil can be easily separated while moving to enable efficient separation of the liquefied oil from the refrigerant gas.

Figure 7:
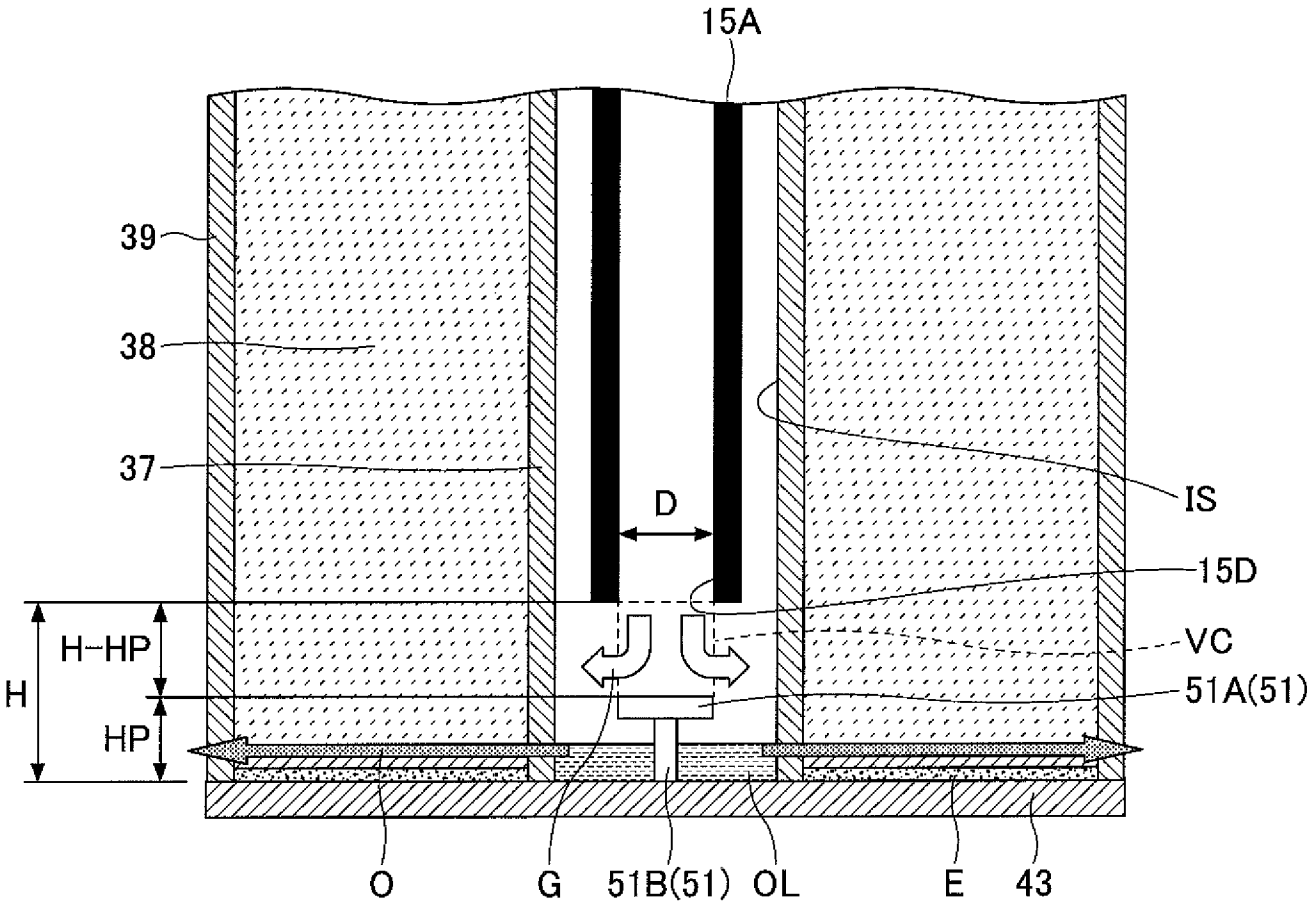
FIG. 7 is an enlarged cross-sectional view of a lower end of a high-pressure gas inlet pipe of an oil separator of Embodiment 2.
Figure 8:
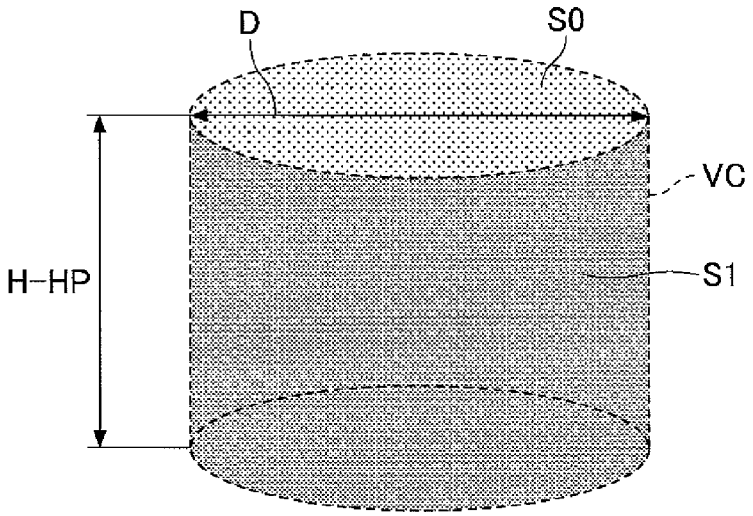
FIG. 8 schematically illustrates a virtual cylindrical surface extending from the lower end of the high-pressure gas inlet pipe to an upper end of a liquefaction promoting member through a side peripheral surface of the high-pressure gas inlet pipe.

FIG. 7 is an enlarged cross-sectional view of the lower end of the high-pressure gas inlet pipe 15A of the oil separator 15*a* and its vicinity of Embodiment 2. FIG. 8 schematically illustrates a virtual cylindrical surface VC extending from the lower end of the high-pressure gas inlet pipe 15A to the upper end of the liquefaction promoting member 51 through a side peripheral surface of the high-pressure gas inlet pipe 15A.

Referring to FIGS. 7-8, the virtual cylindrical surface VC may be formed by extending the inner side periphery of the high-pressure gas inlet pipe 15A from the lower end, namely the high-pressure gas inlet port 15D, to the liquefaction promoting member 51. The diameter of the high-pressure gas inlet pipe 15A is designated by D and the cross-sectional area thereof designated by S0. Further, the height of the liquefaction promoting member 51 is designated by HP. At this time, the height of the virtual cylindrical surface VC is H-HP. When an area S1 ($S1=\pi D(H-HP)$) of the virtual cylindrical surface VC is smaller than the cross-sectional area S0 ($S0=\pi(D/2)^2$) of the high-pressure gas inlet pipe 15A, a flow passage cross-sectional area for the flow G of the refrigerant gas below the lower end of the high-pressure gas inlet pipe 15A becomes smaller than a flow passage cross-sectional area inside the high-pressure gas inlet pipe 15A. Therefore, a pressure loss may occur in the gas at a time of changing the direction at the lower end to thereby decrease the pressure of the refrigerant gas being the high pressure gas introduced from the oil separator 15*a* and degrade refrigeration capacity of the refrigerator 30.

Therefore, it is preferable to make the area S1 of the virtual cylindrical surface VC be the cross-sectional area S0 of the high-pressure gas inlet pipe 15A or greater. In this case, the flow passage cross-sectional area of the flow G of the refrigerant gas which changes its direction at the lower end of the high-pressure gas inlet pipe 15A is the flow passage cross-sectional area inside the high-pressure gas inlet pipe 15A or greater. Therefore, a pressure loss does not occur in the gas at the time of changing the direction at the lower end to thereby prevent from decreasing the pressure of the refrigerant gas being the high pressure gas introduced from the oil separator 15 and degrading the refrigeration capacity of the refrigerator 30.

Referring to FIG. 7, also in Embodiment 2, it is preferable to bond the lower lid 43 to a lower portion of the filter member 38 by an adhesive agent E having a seal-up capability such as an epoxy adhesive and a silicon adhesive. With this bonding, it is possible to prevent a gap from occurring between the filter member 38 and the lower lid 43. Therefore, it is possible to prevent the refrigerant gas containing the oil, which is introduced from the high-pressure gas inlet port 15D into the internal space IS, from flowing through the gap into the external space ES.

Within the Embodiment, when the oil mist contained in the refrigerant gas which are introduced into the internal space IS is sprayed on the upper plate portion 51A and liquefied, the liquefied oil OL is accumulated below the upper plate portion 51A. Therefore, the upper plate portion 51A is not soaked by the oil OL. Therefore, the effect of spraying the oil mist contained in the refrigerant gas introduced into the internal space IS to liquefy the oil mist can be maintained to be long-lasting.

Figure 9A:
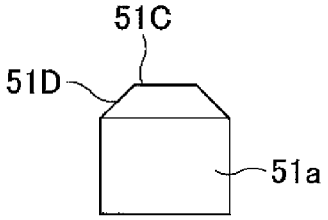
FIG. 9A is a side view of a structural example of the liquefaction promoting member.
Figure 9B:
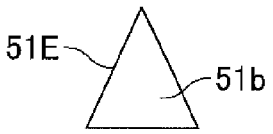
FIG. 9B is aside view of another structural example of the liquefaction promoting member.

FIG. 9A and FIG. 9B are side views of a structural example of the liquefaction promoting member 51.

Instead of the liquefaction promoting member 51 having the T-like shape illustrated in FIG. 7, the liquefaction promoting member 51*a* shaped to have a circular cylindrical shape and a tapered portion 51D around an upper surface portion as illustrated in FIG. 9A may be used. In this case, the refrigerant gas introduced from the high-pressure gas inlet port 15D is sprayed on the upper surface portion 51C or the tapered portion 51D of the liquefaction promoting member 51*a*. Meanwhile, a liquefaction promoting member 51*b* having a conical shape and a conical surface 51E illustrated in FIG. 9B may be used. In this case, the refrigerant gas introduced from the high-pressure gas inlet port 15D is sprayed on the conical surface 51E of the liquefaction promoting member 51*b*.

First Modified Example of Embodiment 2

Figure 10:
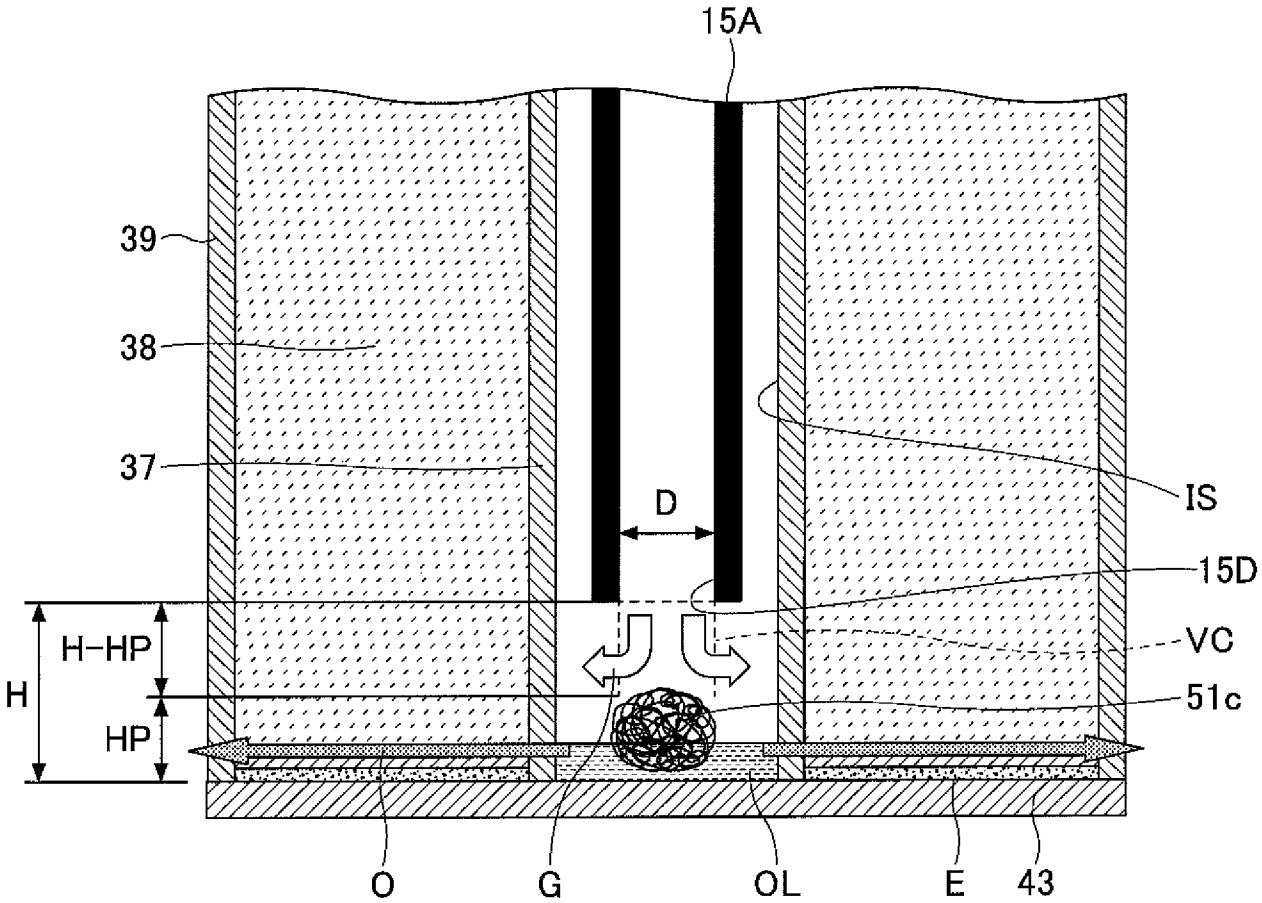
FIG. 10 is an enlarged cross-sectional view of a lower end of a high-pressure gas inlet pipe of an oil separator of a first modified example of Embodiment 2.

Referring to FIG. 10, an oil separator of a first modified example of Embodiment 2 is described. A liquefaction promoting member 51*c* is provided between the lower end of the high-pressure gas inlet pipe 15A and the lower lid 43 in the oil separator of the first modified example of Embodiment 2.

FIG. 10 is an enlarged cross-sectional view of the lower end of the high-pressure gas inlet pipe 15A of the oil separator and its vicinity of the first modified example of Embodiment 2.

Portions other than the liquefaction promoting member 51*c* in the oil separator of the first modified example of Embodiment 2 are the same as those of the oil separator 15*a* of Embodiment 2. Therefore, explanation of the portions other than the liquefaction promoting member 51*c* in the oil separator of the first modified example of Embodiment 2 is omitted.

The liquefaction promoting member 51*c* is preferably made of a fibrous material. Then, the oil mist contained in the refrigerant gas introduced into the internal space IS from the high-pressure gas inlet port 15D is sprayed on the fibrous material to thereby promote liquefaction of the oil mist.

Furthermore, the liquefaction promoting member 51*c* preferably made of a more coarsely formed fibrous material than the material of the filter member 38 such as steel wool. In this case, the liquefaction of the oil mist contained in the refrigerant gas introduced into the internal space IS from the high-pressure gas inlet port 15D can be promoted and the liquefied oil OL does not remain inside the liquefaction promoting member 51*c* and flows toward the filter member 38. Therefore, the oil liquefied by the filter member 38 can be efficiently separated from the refrigerant gas.

Referring to FIG. 10, also in the first modified example of Embodiment 2, it is preferable to bond the lower lid 43 to the lower portion of the filter member 38 by an adhesive agent E having a seal-up capability such as an epoxy adhesive and a silicon adhesive. With this bonding, it is possible to prevent a gap from occurring between the filter member 38 and the lower lid 43. Therefore, it is possible to prevent the refrigerant gas containing the oil, which is introduced from the high-pressure gas inlet port 15D into the internal space IS, from flowing through the gap into the external space ES.

Second Modified Example of Embodiment 2

Figure 11:
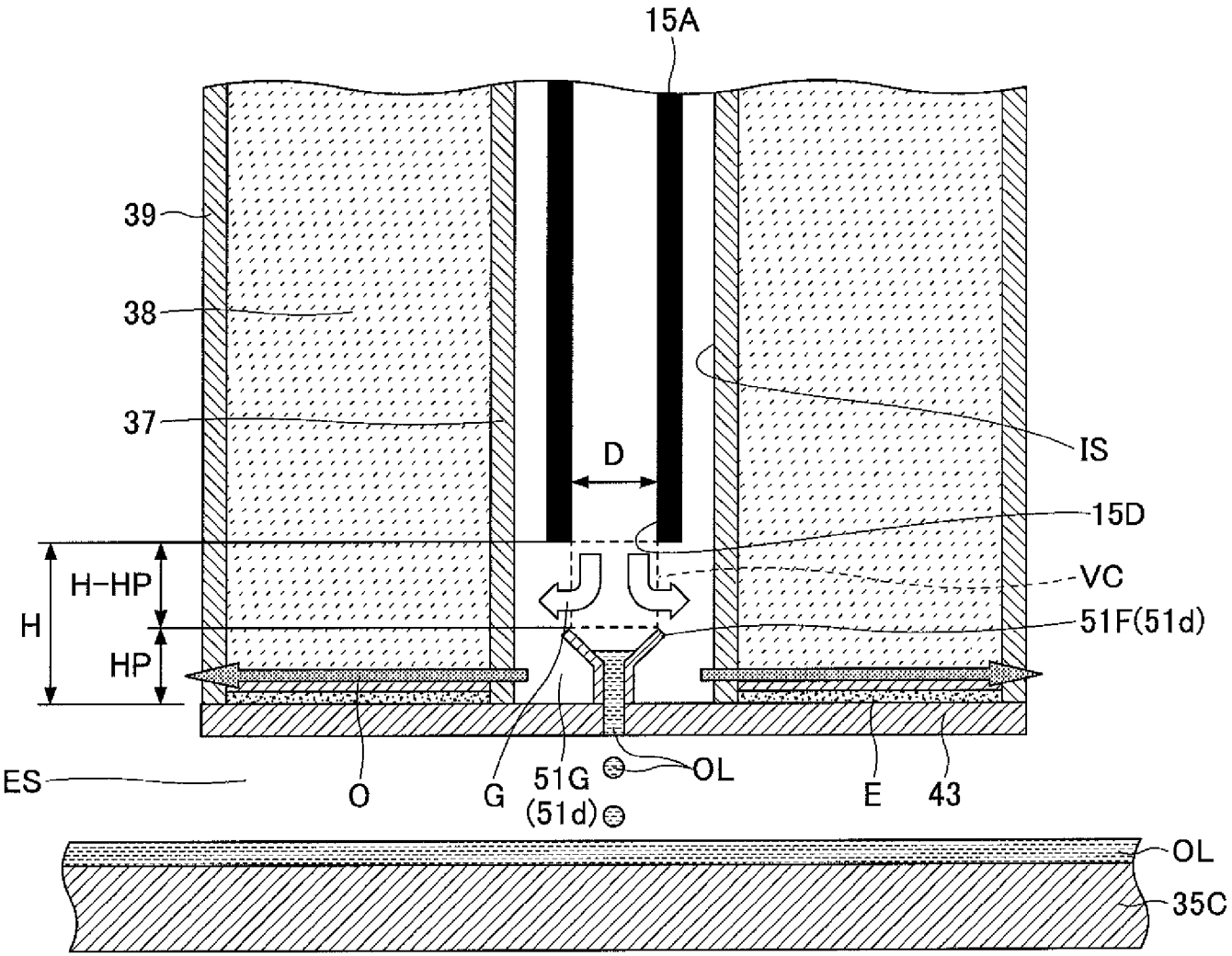
FIG. 11 is an enlarged cross-sectional view of a lower end of a high-pressure gas inlet pipe of an oil separator of a second modified example of Embodiment 2.

Referring to FIG. 11, an oil separator of a second modified example of Embodiment 2 is described. The oil separator of the second modified example of Embodiment 2 includes a liquefaction promoting member 51*d* shaped like an funnel having a receiving portion configured to receive liquefied oil.

FIG. 11 is an enlarged cross-sectional view of the lower end of the high-pressure gas inlet pipe 15A of the oil separator and its vicinity of the second modified example of Embodiment 2.

Portions other than the liquefaction promoting member 51*d* in the oil separator of the second modified example of Embodiment 2 are the same as those of the oil separator 15*a* of Embodiment 2. Therefore, explanation of the portions other than the liquefaction promoting member 51*d* in the oil separator of the second modified example of Embodiment 2 is omitted.

The liquefaction promoting member 51*d* includes a receiving portion 51*d* and a discharging tube portion 51G shaped like a funnel. The receiving portion 51F is shaped like a circular cone. When the oil mist contained in the refrigerant gas introduced from the high-pressure gas inlet port 15D is sprayed on the receiving portion 51F, liquefaction of the oil mist is promoted. The liquefied oil OL of the oil mist is accumulated in the receiving portion 51F. A center bottom portion of the receiving portion 51F is connected to a pipe line formed inside the discharging tube portion 51G. The pipe line formed inside the discharging tube portion 51G penetrates through the lower lid 43 and is connected to the external space ES via an opening formed on a bottom surface of the lower lid 43. Then, the oil mist contained in the refrigerant gas introduced into the internal space IS from the high-pressure gas inlet port 15D is sprayed on the receiving portion 51F to thereby promote liquefaction of the oil mist. The liquefied oil OL passes through the receiving portion 51F and the pipe line formed inside the discharging tube portion 51G and flows out of the external space ES. Thus, the liquefaction promoting member 51*d* can aid a function of filtering out the liquefied oil OL by the filter member 38 to thereby further efficiently separate the liquefied oil from the refrigerant gas.

Referring to FIG. 11, also in the second modified example of Embodiment 2, it is preferable to bond the lower lid 43 to the lower portion of the filter member 38 by an adhesive agent E having a seal-up capability such as an epoxy adhesive and a silicon adhesive. With this bonding, it is possible to prevent a gap from occurring between the filter member 38 and the lower lid 43. Therefore, it is possible to prevent the refrigerant gas containing the oil, which is introduced from the high-pressure gas inlet port 150 into the internal space IS, from flowing through the gap into the external space ES.

As described, according to the oil separator for separating oil from refrigerant gas supplied from a compressor for the refrigerator of the embodiments, oil mist contained in the refrigerant gas can be efficiently liquefied and the liquefied oil can be efficiently separated from the refrigerant gas.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of superiority or inferiority of the invention. Although the embodiments of the present invention have been described in detail, it should be understood that the various changes, substitutions, and alterations could be made hereto without departing from the spirit and scope of the invention.

What is claimed is:

1. An oil separator provided in a flow path of a refrigerant gas flowing from a compressor to a refrigerator, the oil separator comprising:

a filter configured to form an internal space by including a filter material having a cylindrical shape, the filter material filtering out oil from the refrigerant gas, an upper lid bonded to an upper portion of the filter material, and a lower lid bonded to a lower portion of the filter material;

a body configured to accommodate the filter;

a gas inlet pipe penetrating through the upper lid, the gas inlet pipe being configured to introduce the refrigerant gas into the internal space; and a gas outlet pipe penetrating through the upper lid, the gas outlet pipe being configured to eject the refrigerant gas from which the oil is filtered out by the filter from an upper portion of the body, wherein a lower end of the gas inlet pipe is opened to the internal space at a position higher than the lower lid and lower than a substantial center between the upper lid and the lower lid.

2. The oil separator according to claim 1, wherein an area of a virtual cylindrical surface formed by extending an inner side periphery of the gas inlet pipe from the lower end to the lower lid is a cross-sectional area of the gas inlet pipe or greater.

3. The oil separator according to claim 1, wherein the lower lid is bonded to a lower portion of the filter material by an adhesive agent having a seal-up capability.

4. The oil separator according to claim 1, wherein the filter includes a liquefaction promoting member provided between the lower end of the gas inlet pipe and the lower lid to promote liquefaction of oil mist of the oil contained in the refrigerant gas, and a height of the lower end of the gas inlet pipe is opened to the internal space at a position higher than the liquefaction promoting member and at the position higher than the lower lid and lower than the substantial center between the upper lid and the lower lid.

5. The oil separator according to claim 4, wherein the liquefaction promoting member is made of a fibrous material.

* * * * *